US010242832B2

(12) United States Patent
Gopa et al.

(10) Patent No.: US 10,242,832 B2
(45) Date of Patent: Mar. 26, 2019

(54) HIGH VOLTAGE CIRCUIT BREAKER

(71) Applicant: SIEMENS AKTIENGESELLSCHAFT, Munich (DE)

(72) Inventors: Srinivas Gopa, Maharashtra (IN); Frank Richter, Brieselang (DE); Amit Shende, Maharashtra (IN); Jörg Teichmann, Dallgow-Döberitz (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 15/543,761

(22) PCT Filed: Jan. 14, 2016

(86) PCT No.: PCT/EP2016/050680
§ 371 (c)(1),
(2) Date: Jul. 14, 2017

(87) PCT Pub. No.: WO2016/116351
PCT Pub. Date: Jul. 28, 2016

(65) Prior Publication Data

US 2017/0372859 A1 Dec. 28, 2017

(30) Foreign Application Priority Data

Jan. 19, 2015 (IN) ..... 63/KOL/2015

(51) Int. Cl.

| | |
|---|---|
| ***H01H 71/10*** | (2006.01) |
| ***H01H 71/02*** | (2006.01) |
| ***H01H 71/08*** | (2006.01) |
| ***H01H 33/16*** | (2006.01) |
| ***H01H 9/54*** | (2006.01) |

(52) U.S. Cl.
CPC ..... *H01H 71/10* (2013.01); *H01H 33/168* (2013.01); *H01H 71/02* (2013.01); *H01H 71/08* (2013.01); *H01H 9/54* (2013.01)

(58) Field of Classification Search
CPC ..... H01H 33/16; H01H 71/02; H01H 71/08; H01H 71/10; H01H 33/168; H01H 33/165; H01H 9/54
USPC ..... 218/158, 102, 143, 144; 361/58; 307/98; 200/144 AP
See application file for complete search history.

(56) References Cited

U.S. PATENT DOCUMENTS 3,995,198 A 11/1976 Kriechbaum
4,009,458 A * 2/1977 Kishi ..... H01H 33/166 218/65

(Continued)

FOREIGN PATENT DOCUMENTS

GB 1466745 A 3/1977

OTHER PUBLICATIONS

International Search Report and Written Opinion for related International Application No. PCT/EP2016/050680 dated Mar. 26, 2016.

*Primary Examiner* — Edwin A. Leon
*Assistant Examiner* — William A Bolton
(74) *Attorney, Agent, or Firm* — Lempia Summerfield Katz LLC

(57) ABSTRACT

An improved circuit breaker is disclosed herein. The improved circuit breaker includes one or more main contacts and only one resistor contact. The only one resistor contact is connected in parallel with at least one of the one or more main contacts.

6 Claims, 3 Drawing Sheets

(56) References Cited

U.S. PATENT DOCUMENTS

| | | | | | |
|---|---|---|---|---|---|
| 4,263,490 | A | | 4/1981 | Van Doan | |
| 4,488,021 | A | * | 12/1984 | Yoshizumi | H01H 33/167<br>218/143 |
| 4,489,291 | A | * | 12/1984 | Toyoda | H01H 33/165<br>338/200 |
| 4,555,603 | A | * | 11/1985 | Aoyama | H02B 13/075<br>218/143 |
| 5,391,930 | A | * | 2/1995 | Ohshita | H01H 33/168<br>307/98 |
| 5,424,504 | A | * | 6/1995 | Tanaka | H01H 33/168<br>218/78 |
| 5,567,924 | A | * | 10/1996 | Yano | H01H 33/166<br>218/143 |
| 8,081,407 | B2 | * | 12/2011 | Willieme | H01H 33/6661<br>361/20 |
| 2009/0067108 | A1 | | 3/2009 | Kruesi et al. | |

* cited by examiner

HIGH VOLTAGE CIRCUIT BREAKER

The present patent document is a § 371 nationalization of PCT Application Serial Number PCT/EP2016/050680, filed Jan. 14, 2016, designating the United States, which is hereby incorporated by reference, and this patent document also claims the benefit of Indian Patent Application Number IN 63/KOL/2015, filed Jan. 19, 2015, which is also hereby incorporated by reference.

TECHNICAL FIELD

The present disclosure relates to a high voltage circuit breaker and more particularly, to a new arrangement of closing resistors in an extra high voltage circuit breaker.

BACKGROUND

From the last few decades, there is a continuous increase in the demand of electrical power for various residential and industrial applications. Hence, the electrical systems are becoming increasingly complex, heavy, and powerful. A requirement of a high voltage electrical system is high voltage switching equipment. The high voltage switching equipment are used to control, protect and isolate electrical modules within the high voltage electrical system. The high voltage switching equipment have a property to act under special conditions. For example, high voltage switching equipment disconnect a section of the electrical system when flow of current goes beyond prescribed limits, which in turn protects the electrical system against damage.

A high voltage switching element used in the electrical systems may be a disconnector, circuit breaker, or a combination of disconnectors and circuit breakers. The most commonly used switching element is a circuit breaker. A circuit breaker is an electrical switch designed for making, carrying, and breaking a flow of normal as well as short circuit current.

High voltage circuit breakers may be used for controlling long transmission lines, (e.g., for extra high voltage electrical systems). The high voltage circuit breakers primarily have two pairs of contacts, (e.g., main contacts and resistor contacts). Functionally, the main contacts of the high voltage circuit breakers may be closed only after the resistor contacts are closed. FIG. 1 illustrates top view of a high voltage circuit breaker 100 in accordance with the state of the art. The high voltage circuit breaker 100 includes two interrupter units 102, 104 and two closing resistor units 106, 108. The high voltage circuit breaker 100 also includes a breaker tank 110. The high voltage circuit breaker 100 is connected between transmission lines, not shown in FIG. 1, such that current enters from the transmission lines in the high voltage circuit breaker 100 through an incoming terminal 112 and current exists from the high voltage circuit breaker 100 through an outgoing terminal 114. The incoming terminal 112 of the high voltage circuit breaker 100 is connected with the incoming interrupter unit 102 and the incoming closing resistor unit 106, as shown in FIG. 1. Additionally, the outgoing terminal 114 of the high voltage circuit breaker 100 is connected with the outgoing interrupter unit 104 and the outgoing closing resistor unit 108. The incoming interrupter unit 102 has an incoming main contact 118 and the outgoing interrupter unit 104 has an outgoing main contact 120. Similarly, the incoming closing resistor unit 106 has an incoming resistor contact 122 and the outgoing closing resistor unit 108 has an outgoing resistor contact 124, as illustrated in FIG. 1. The main contacts 118, 120 have fixed terminals 118A, 120A and moving terminals 118B, 120B, respectively. Also, the resistor contacts 122, 124 have fixed terminals 122A, 124A and moving terminals 122B, 124B, as shown in FIG. 1. When the moving terminals 118B, 120B, 122B, 124B move away from the respective fixed terminals 118A, 120A, 122A, 124A, respectively, then current stop flowing from the incoming terminal 112 to the outgoing terminal 114. The condition under which current stops flowing through the high voltage circuit breaker 100 is known as breaker open condition. The breaker tank 110, shown in FIG. 1, is a housing for mechanical linkages 116 that operates the main contacts 118, 120 and the resistor contacts 122, 124. The breaker tank 110 also holds the interrupter units 102, 104 and the closing resistor units 106, 108 together at an elevated height. The breaker tank 110 is supported by an insulated pole and a base along with a drive mechanism, not shown in FIG. 1. The drive mechanism derives the mechanical links 116 through the insulated pole.

During normal operation of the high voltage circuit breaker 100, the main contacts 118, 120 of the interrupter units 102, 104 are closed, e.g., the fixed terminals 118A, 120A and moving terminals 118B, 120B of the main contacts 118, 120 are in contact with each other. Also during normal operation, (e.g., when current is flowing though the high voltage circuit breaker 100), the resistor contacts 122, 124 of the closing resistor units 106, 108 are open, e.g., the fixed terminals 122A, 124A and moving terminals 122B, 124B of the resistor contacts 122, 124 are not in contact with each other. Under certain conditions, like faults or maintenance requirements, it is required to break the flow of current in some section or all sections of an electrical system. To break the flow of current, the main contacts 118, 120 of the high voltage circuit breaker 100 are needed to be opened, (e.g., breaker open condition that leads to restrict the flow of current from the incoming terminal 112 to the outgoing terminal 114), which in turn leads to the isolation of some section or all sections of the electrical system.

For the functioning of the electrical system, it is needed that all the sections of the electrical system should be electrically connected. Hence after the breaker open condition, once the fault is rectified or the maintenance is completed, then it is required to reconnect the main contacts 118, 120 of the high voltage circuit breaker 100 to resume the flow of current. According to the state of the art, a direct connection of the main contacts 118, 120 is avoided because a sudden connection of the main contacts 118, 120 over voltage condition due to switching transients, which might lead to complete breakdown of the electrical system. To avoid the effects of the switching transients, closing resistor units 106, 108 with the resistor contacts 122, 124 are provided. To resume the flow of current through the high voltage circuit breaker 100, it is recommended that closing of the main contacts 118, 120 should be followed by the closing of the resistor contacts 122, 124. The resistor contacts 122, 124 provide damping effect to over voltage arises due to switching transients, which leads an additional protection of for the high voltage circuit breaker 100.

FIG. 2 illustrates a circuit 200 of the high voltage circuit breaker 100. In the circuit 200, the main contacts 118, 120 and resistor contacts 122, 124 are represented as switches 118, 120, 122, 124 that are connecting the incoming terminal 112 and the outgoing going terminal 114 of the high voltage circuit breaker 100. All the switches 118, 120, 122, 124 of the circuit 200 are open, which represents the breaker open condition, as illustrated in FIG. 2. The circuit 200 also includes resistors R1, R2, R3, R4 providing resistance to the resistor contact units 106, 108. To resume the flow of current through the high voltage circuit breaker 100 after the breaker open condition, first the switches, (e.g., the resistor contacts 122, 124), are closed, which leads to a flow of current between the incoming terminal 112 and the outgoing terminal 114 through the resistors R1, R2, R3, R4 that provides a damping effect. After a pre-defined time delay, the switches, (e.g., the main contacts 118, 120), are closed after closing the switches 122, 124. Because of the closing of the switches, (e.g., the main contacts 118, 120), current started flowing between the incoming terminal 112 and the outgoing terminal 114 through the interrupter units 102, 104. Almost all current flows through the interrupter units 102, 104 instead of the closing resistor units 106, 108 because the interrupter units 102, 104 offer a less resistive path for current in comparison to the closing resistor units 106, 108. After stabilization of flow of current through the interrupter units 102, 104, the switches, (e.g., the resistor contacts 122, 124), are set to an open condition to make sure no current flow through the closing resistor units 106, 108.

The high voltage circuit breaker 100, illustrated in FIG. 1 and FIG. 2, needs a good amount of material for manufacturing due to the presence of multiple closing resistor units, which also increases the weight of the overall circuit breaker assembly. Due to high weight of the circuit breaker, it becomes problematic to keep the circuit breaker at an elevated height and it causes mechanical stability problems. Also, the time required to assemble the high voltage circuit breaker is also high because of the complexity of the circuit breaker due to the presence of multiple closing resistor units. Additionally, the circuit breaker, as disclosed in the state of the art, is susceptible to high risk of failure due to seismic load because of its complex design and weight. Further, due to the presence of multiple main and resistor contacts, high mechanical energy is required for operating the contacts because more number of contacts leads to more number of moving parts. In other words, high mechanical energy is required for the mechanical links 116, illustrated in FIG. 1, because the mechanical links 116 are operating the four moving terminals 118B, 120B, 122B, 124B.

From the above-mentioned problems associated with a circuit breaker, it is evident that there is a strong need of a less complex, light in weight, and easy to assemble circuit breaker.

SUMMARY AND DESCRIPTION

It is therefore an object of the present disclosure to provide an improved circuit breaker for which less material for manufacturing is needed and also has a less complex configuration.

The object is achieved by providing an improved circuit breaker having main contacts and only one resistor contact.

In one aspect, an improved circuit breaker is disclosed. The improved circuit breaker includes one or more main contacts and only one resistor contact. The only one resistor contact is connected in parallel with at least one of the one or more main contacts.

In accordance with the aspect, each of the one or more main contacts includes at least one first fixed terminal and at least one first moving terminal. Also, the only one resistor contact includes at least one second fixed terminal and at least one second moving terminal.

Further, in accordance with the aspect, the improved circuit breaker also includes at least one breaker tank. The at least one breaker tank includes a plurality of links. The plurality of links of the at least one breaker tank are mechanical connections and are used for connecting, together or solely, the at least one first moving terminal and the at least one second moving terminal with at least one drive mechanism. The drive mechanism drives the at least one first moving terminal and/or the at least one second moving terminal for closing and/or opening of the one and more main contacts and only one resistor contact.

Furthermore, in accordance with the aspect, the only one resistor contact of the improved circuit breaker includes at least one resistive element. The resistive element may include, but not limited to, at least one active electrical component, at least one passive electrical component or a combination of one or more passive and/or one or more active electrical components.

Also in accordance with the aspect, the one or more main contacts are enclosed in one or more interrupter units. The one or more interrupter units include, but are not limited to, the one or more main contacts along with a plurality of contact supporting components. One or more outer portions of the one or more interrupter units may include, but are not limited to, one or more layers of one or more insulating material. Additionally, the only one resistor contact is enclosed in only one closing resistor unit. The only one closing resistor unit includes, but is not limited to, the only one resistive contact, the at least one resistive element, and some resistor contact support components. One or more outer portions of the only one closing resistor unit may include, but are not limited to, one or more layers of one or more insulating materials.

Accordingly, the present disclosure provides an efficient, light in weight, and less complex improved circuit breaker.

BRIEF DESCRIPTION OF THE DRAWINGS

The present disclosure is further described hereinafter with reference to illustrated embodiments shown in the accompanying drawings, in which.

DETAILED DESCRIPTION

Figure 1:
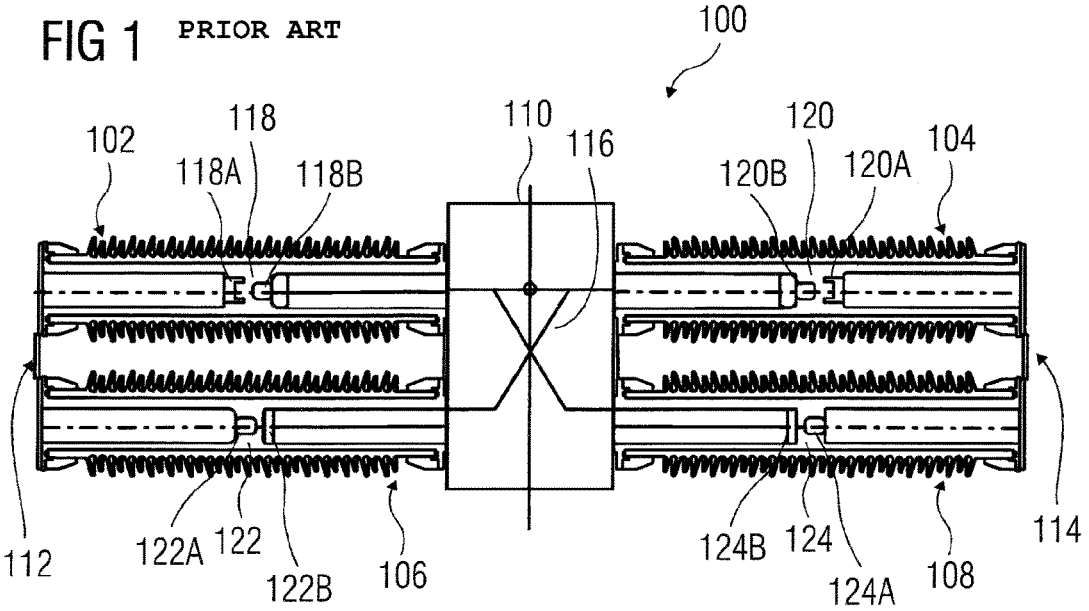
FIG 1 PRIOR ART
FIG. 1 illustrates a high voltage circuit breaker in accordance with the state of the art.

Various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

Figure 3:
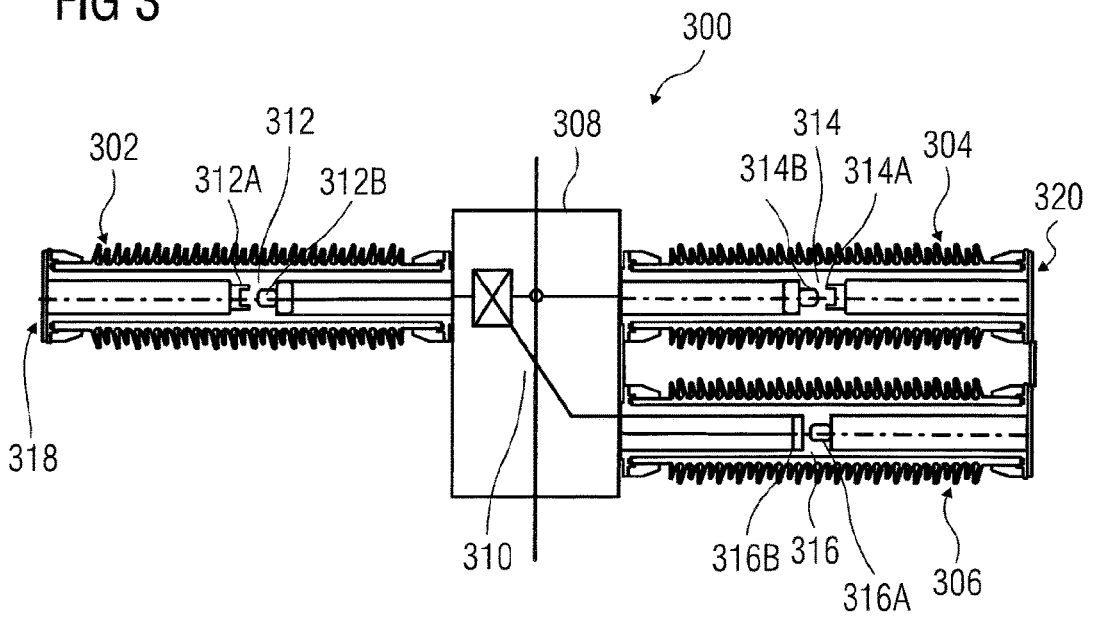
FIG. 3 illustrates an improved circuit breaker in accordance with an embodiment.

FIG. 3 illustrates an improved circuit breaker 300 in accordance with an embodiment. The improved circuit breaker 300 includes two interrupter units 302, 304 and a closing resistor unit 306. The improved circuit breaker 300 also includes a breaker tank 308, an incoming terminal 318, and an outgoing terminal 320. The breaker tank 308 including mechanical links 310, as illustrated in FIG. 3. During normal operation, current is flowing through the improved circuit breaker 300 from the incoming terminal 318 to the outgoing terminal 320 through the incoming interrupter unit 302 and the outgoing interrupter unit 304. A flow of current from the terminal 318 to terminal 320, as described in FIG. 3, is merely for demonstration purposes. In other embodiments, the current may flow from the terminal 320 to the terminal 318. The interrupter units 302, 304 include main contacts 312, 314 respectively, and the resistor closing unit 306 includes a resistor contact 316, as illustrated in FIG. 3. The shape and functionality of the main contacts 312, 314 are the same as the shape and functionality of the main contacts 118, 120 of the high voltage circuit breaker 100, illustrated in FIG. 1. The main contacts 312, 314 include fixed terminals 312A, 314A and moving terminals 312B, 314B, respectively, as shown in FIG. 3. Also, the resistor contact 316 of the improved circuit breaker 300 is functionally similar to the resistor contacts 122, 124 of the high voltage circuit breaker 100, illustrated in FIG. 1. The resistor contact 316 includes a fixed contact 316A and a moving contact 316B, as illustrated in FIG. 3. All three moving contacts 312B, 314B, 316B are connected to the mechanical links 310 of the breaker tank 308, as shown in FIG. 3.

During normal flow of current through the improved circuit breaker 300, the fixed contacts 312A, 314A of the main contacts 312, 314 are connected to the moving contacts 312B, 314B, respectively, and the fixed contact 316A of the resistor contact 316 is not connected with the moving contact 316B. In other words, during normal flow of current, the main contacts 312, 314 of the interrupter units 302, 304 remain in a closed state and the resistor contact 316 of the closing resistor unit 306 remains in an open state. In case of a fault or maintenance requirement, the improved circuit breaker 300 is needed to be in breaker open condition so that the flow of current through the improved circuit breaker 300 may be restricted. In order to achieve the breaker open condition, all the contacts, (e.g., the main contacts 312, 314 and the resistor contact 316), of the improved circuit breaker are set to be in an open state, as illustrated in FIG. 3. After completion of the maintenance and/or rectification of the fault, it is needed to resume a flow of current through the improved circuit breaker 300. To resume the flow of current, it is required that the improved breaker 300 attains its normal condition under which the main contacts 312, 314 of the interrupter units 302, 304 of the improved circuit breaker 300 should be closed and the resistor contact 316 of the closing resistor unit 306 of the improved circuit breaker 300 should be open. A step-by-step circuit level functionality of the improved circuit breaker 300 from the breaker open condition to the normal condition is explained in following figures.

Figure 4:
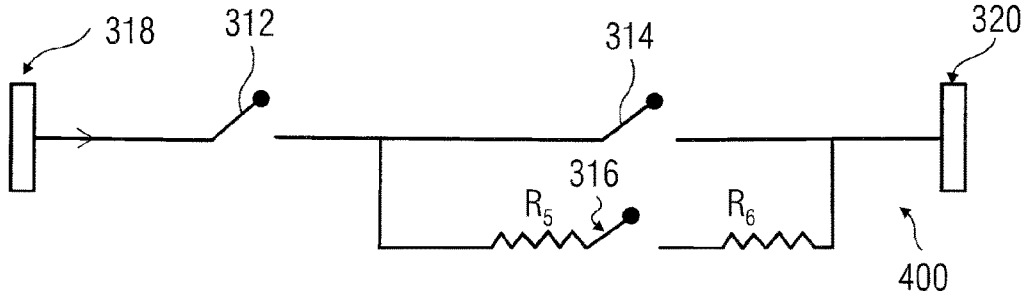
FIG. 4 illustrates a circuit of the improved circuit breaker of FIG. 3 under breaker open condition in accordance with an embodiment.

FIG. 4 illustrates a circuit 400 of the improved circuit breaker 300 during breaker open condition. The main contacts 312, 314 and the resistor contact 316 of the improved circuit breaker 300 are illustrated as switches 312, 314, 316 of the circuit 400 in FIG. 4. The circuit 400 of the improved circuit breaker 300 also includes resistors R5, R6 representing the resistance offered by the closing resistor unit 306 of the improved circuit breaker 300, illustrated in FIG. 3. In one embodiment, a resistance value offered by the resistors R5, R6 is equivalent to the resistance value offered by the resistors R1, R2, R3, R4 of the circuit 200 of the high voltage circuit breaker 100 shown in FIG. 2. During the breaker open condition, all the contacts 312, 314, 316 are open; hence no flow of current between the incoming terminal 318 and the outgoing terminal 320 of the improved circuit breaker 300, as illustrated in FIG. 4.

Figure 5:
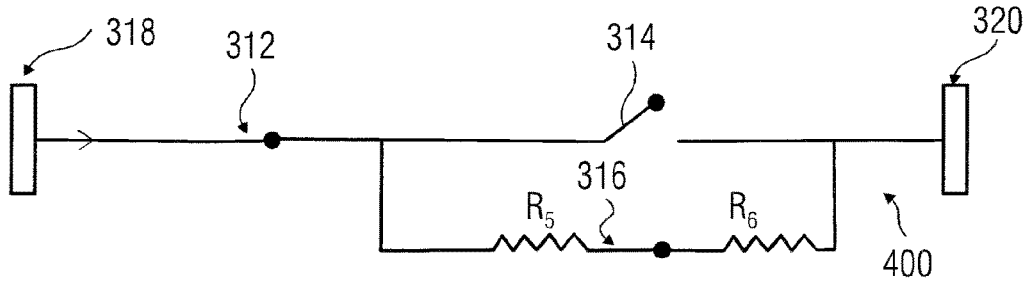
FIG. 5 illustrates the circuit of the improved circuit breaker of FIG. 3 under closing resistor closed condition in accordance with an embodiment.

To resume the flow of current through the improved circuit breaker 300, at least one contact out of the outgoing main contact 314 and the resistor contact 316 should be in a closed state along with the incoming main contact 312. If the main contacts 312, 314 get back to the closed state directly, it will lead to over-voltage due to switching transients that may negatively affect the electrical system. To avoid the over-voltage, the resistor contact 316 should attain a closed state along with the incoming main contact 312, as illustrated in FIG. 5. When the incoming main contact 312 is closed along with the resistor contact 316 and the outgoing main contact is open, as shown in FIG. 5, then the improved circuit breaker 300 is considered to be in a closing resistor closed condition. Once the incoming main contact 312 and the resistor contact 316 are in a closed state along with the outgoing main contact 314 in an open state, the current will start flowing between the incoming terminal 318 and the outgoing terminal 320 through the resistors R5, R6, the resistor contact 316 and the incoming main contact 312, as illustrated in FIG. 5. The over-voltage due to switching transients is avoided because of the damping effect provided by the resistors R5, R6.

Figure 6:
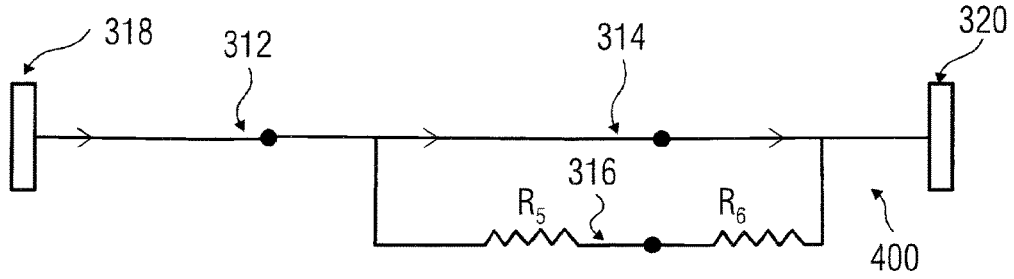
FIG. 6 illustrates the circuit of the improved circuit breaker of FIG. 3 under breaker closed condition in accordance with an embodiment.

After a pre-defined time delay, the outgoing main contact 314 also attains a closed state along with the incoming main contact 312 and the resistor contact 316, as illustrated in FIG. 6. The pre-defined time delay is defined on the basis of an amount of current flowing through the improved circuit breaker 300, the resistance value offered by the resistors R5, R6 and other system parameters. Various methods for calculating the pre-defined time delay based on the electrical system parameters including, but not limited to, current and resistance value, are disclosed in the state of the art. In one embodiment, the pre-defined time delay is 10 milliseconds. When all the contacts, (e.g., the incoming main contact 312, the outgoing main contact 314, and the resistor contact 316), are in a closed state, then the improved circuit breaker 300 attains a breaker closed condition, as illustrated in FIG. 6. In one embodiment, the breaker closed condition, illustrated in FIG. 6, is a normal condition of operation for the improved circuit breaker 300. In an embodiment, all the contacts, (e.g., the incoming main contact 312, the outgoing main contact 314, and the resistor contact 316), are closed during the normal operation of the improved circuit breaker 300 and as the interrupter unit 304 offers negligible resistance in comparison to the closing resistor unit 306; hence, almost all the current will flow through the interrupter units 302, 304 instead of the closing resistor unit 306.

Figure 7:
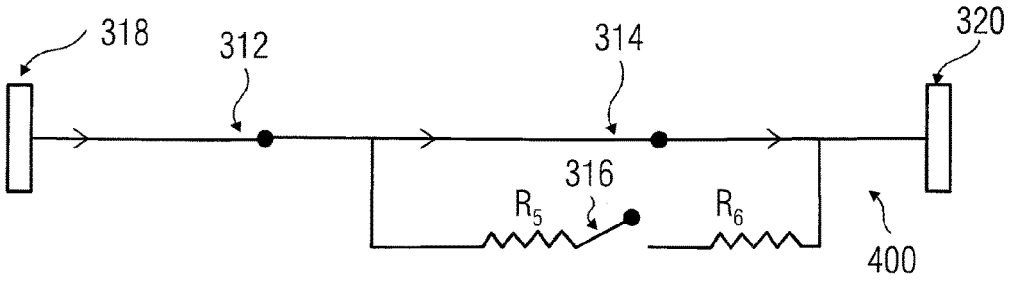
FIG. 7 illustrates the circuit of the improved circuit breaker of FIG. 3 under normal condition in accordance with an embodiment.

After the improved circuit breaker 300 attains the breaker closed condition, then the current start flowing from both the contacts, that are the outgoing main contact 314 and the resistor contact 316, as the two contacts are connected in parallel. However, a significant current will flow through the outgoing main contact 314 in comparison to the resistor contact 316 because the interrupter unit 304 offers negligible resistance in comparison to the closing resistor unit 306. The closing resistor unit 306 offers a substantial resistance to the flow of current in comparison of the interrupter unit 304 even then some current may flow through the closing resistor unit 306. If the current start flowing through the closing resistor unit 306, (e.g., if the current start flowing through the resistor contact 316 and the resistors R5, R6, as illustrated in preceding figures), then the current will negatively affect the efficiency of the improved circuit breaker 300. In other words, the flow of current through the resistors R5, R6 will lead to loss of power that degrades the efficiency of the improved circuit breaker 300. Hence, to avoid the power loss, the resistor contact 316 should return to an open state after closing of the outgoing main contact 314, as illustrated in FIG. 7. The circuit 400, shown in FIG. 7, illustrates the state of the main contacts 312, 314, (e.g., in a closed state), and the resistor contact 316, (e.g., in an open state), for the improved circuit breaker under the normal condition of operation, e.g., when the current is flowing through a minimum resistance path of the improved circuit breaker 300. The normal condition of the circuit 400 of the improved circuit breaker 300 may also be known as closing resistor open condition.

Figure 2:
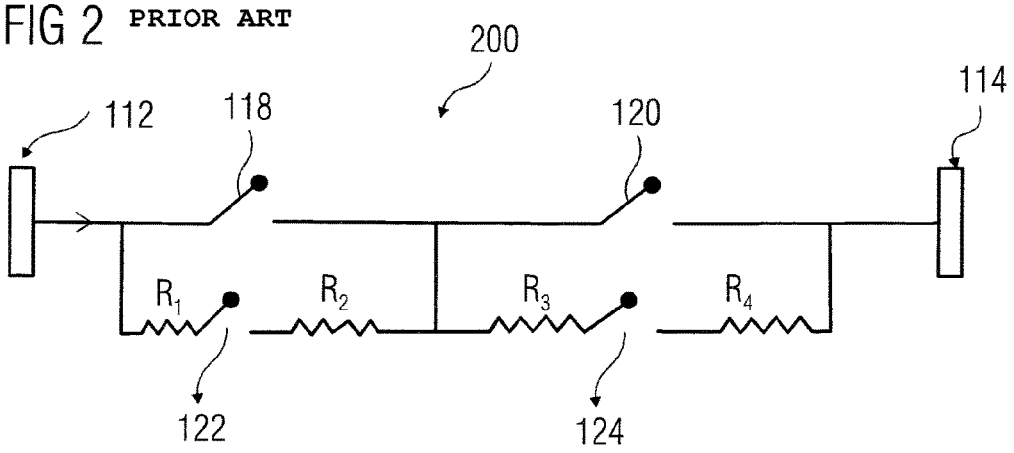
FIG 2 PRIOR ART
FIG. 2 illustrates a circuit diagram of the high voltage circuit breaker of FIG. 1 in accordance with the state of the art.

FIG. 2 depicts an exemplary embodiment. In the embodiment, the resistor closing unit 306 is connected in parallel with the incoming interrupter unit 302. In another exemplary embodiment, the improved circuit breaker 300 includes one or more than one interrupter units 302, 304. In the exemplary embodiment, the closing resistor unit 306 is connected in parallel with at least one of the one or more than more interrupter units 302, 304.

The resistors R5, R6 illustrated in FIG. 4 to FIG. 7 are merely for explanation purpose. In other embodiments, however, a combination of active and/or passive electrical devices and/or components may be used instead of or in combination with the resistors R5, R6.

An improved circuit breaker 300 is disclosed for which less amount of manufacturing materials are required in comparison to the circuit breaker know in the state of the art. Additionally, the improved circuit breaker 300 is light in weight; hence easy to keep the improved circuit breaker 300 at an elevated height without any mechanical stability problems. In the improved circuit breaker 300, the use of only one closing resistor unit 306 reduces significantly the complexity of the breaker tank 308 and also reduces the complexity of the improved circuit breaker 300. Due to less complexity of the improved circuit breaker 300, in comparison to the circuit breakers known in the state of the art, it becomes possible to assemble the improved circuit breaker 300 quickly. Further, due to less complex design and light weight, the improved circuit breaker 300 is significantly less susceptible to seismic load failure risk in comparison of the circuit breakers known in the state of the art. Furthermore, due to significant reduction in the closing resistor units in the improved circuit breaker 300, in comparison to the circuit breakers known in the state of the art, the mechanical energy required for operating the contacts of the improved circuit breaker 300 is significantly less than the mechanical energy required for operating the contacts of the circuit breaker known in the state of the art.

From the foregoing description, it is evident that the present disclosure provides a light weight, less complex, and efficient improved circuit breaker.

While the present disclosure has been described in detail with reference to certain embodiments, it should be appreciated that the present disclosure is not limited to those embodiments. In view of the present disclosure, many modifications and variations would present themselves, to those of skill in the art without departing from the scope of various embodiments, as described herein. The scope of the present disclosure is, therefore, indicated by the following claims rather than by the foregoing description. All changes, modifications, and variations coming within the meaning and range of equivalency of the claims are to be considered within their scope.

The invention claimed is:

1. A circuit breaker comprising:

a plurality of main contacts, wherein each main contact of the plurality of main contacts comprises a fixed terminal and a moving terminal;

one and only one resistor contact having a fixed terminal and a moving terminal, wherein the one and only one resistor contact is connected in parallel with at least one main contact of the plurality of main contacts; and at least one breaker tank comprising a plurality of mechanical links, wherein the plurality of mechanical links is connected with the moving terminal of each main contact of the plurality of main contacts and the moving terminal of the one and only one resistor contact, wherein the at least one breaker tank is configured to perform one or more of closing and opening of the plurality of main contacts and the one and only one resistor contact, and wherein, in a closed configuration of the circuit breaker, the moving terminals of two main contacts of the plurality of main contacts are connected with the respective fixed terminals of the two main contacts and the moving terminal of the one and only resistor contact is not connected with the fixed terminal of the one and only resistor contact.

2. The circuit breaker of claim 1, wherein the one and only one resistor contact comprises at least one resistive component.

3. The circuit breaker of claim 2, wherein the plurality of main contacts are enclosed in one or more interrupter units.

4. The circuit breaker of claim 2, wherein the one and only one resistor contact is enclosed in one and only one closing resistor unit.

5. The circuit breaker of claim 1, wherein the plurality of main contacts are enclosed in one or more interrupter units.

6. The circuit breaker of claim 1, wherein the one and only one resistor contact is enclosed in one and only one closing resistor unit.

* * * * *